US009958120B2

(12) United States Patent
Liu et al.

(10) Patent No.: US 9,958,120 B2
(45) Date of Patent: May 1, 2018

(54) TUBE LAMP

(71) Applicant: ANGELED CO., LTD., Baoan District, Shenzhen (CN)

(72) Inventors: Jianjun Liu, Shenzhen (CN); Qibin Yuan, Shenzhen (CN); Youqing Liang, Shenzhen (CN)

(73) Assignee: ANGELED CO., LTD., Shenzhen (CN)

( * ) Notice: Subject to any disclaimer, the term of this patent is extended or adjusted under 35 U.S.C. 154(b) by 0 days. days.

(21) Appl. No.: 15/119,970

(22) PCT Filed: Jun. 10, 2015

(86) PCT No.: PCT/CN2015/081133
§ 371 (c)(1),
(2) Date: Aug. 18, 2016

(87) PCT Pub. No.: WO2016/179871
PCT Pub. Date: Nov. 17, 2016

(65) Prior Publication Data

US 2017/0159899 A1 Jun. 8, 2017

(30) Foreign Application Priority Data

May 14, 2015 (CN) ..... 2015 2 0311261 U

(51) Int. Cl.
*F21S 8/02* (2006.01)
*F21S 8/04* (2006.01)
*F21V 21/04* (2006.01)

(52) U.S. Cl.
CPC ..... *F21S 8/026* (2013.01); *F21S 8/02* (2013.01); *F21S 8/043* (2013.01); *F21V 21/04* (2013.01)

(58) Field of Classification Search
CPC ... F21S 8/02; F21S 8/026; F21S 8/043; F21V 21/04; F21V 21/10
See application file for complete search history.

(56) References Cited

U.S. PATENT DOCUMENTS 6,740,813 B1 * 5/2004 Gretz ..... H02G 3/20 174/66
8,430,535 B2 * 4/2013 Watanabe ..... F21V 19/001 362/294
9,581,302 B2 * 2/2017 Danesh ..... F21S 8/02
9,627,599 B2 * 4/2017 Lee ..... H01L 33/642
9,657,925 B2 * 5/2017 Feit ..... F21V 21/04

* cited by examiner

*Primary Examiner* — Peggy Neils
(74) *Attorney, Agent, or Firm* — Stein IP, LLC

(57) ABSTRACT

Disclosed is a tube lamp, comprising a mounting box and a lamp body matched with the mounting box, the mounting box comprising a top plate and side wall boards around the top plate; the tube lamp also comprises a fixed board; the fixed board comprises a fixed board body; at least two sets of fasteners are disposed at the two ends of the fixed board body; the fasteners are interspaced; the fixed board is detachably connected to the mounting box through the fasteners; and the lamp body is connected to the mounting box through the fixed board. At least two sets of fasteners are disposed at the two ends of the fixed board body; the fasteners are used for connection with the mounting box; the two sets of fasteners are interspaced, capable of being applied to many mounting boxes of different sizes, so the tube lamp has higher compatibility.

3 Claims, 3 Drawing Sheets

TUBE LAMP

CROSS-REFERENCE TO RELATED APPLICATIONS

This application is a national stage of International Application No. PCT/CN2015/081133, filed Jun. 10, 2015, which claims the benefit of priority to Chinese Application No. 201520311261.5, filed May 14, 2015, in the State Intellectual Property Office, the disclosures of which are incorporated in their entireties herein by reference.

TECHNICAL FIELD

The present invention relates to the field of lighting devices, in particular to a tube lamp.

DESCRIPTION OF THE RELATED ART

A tube lamp is a lighting fitting which is embedded in a ceiling and emits light downward. The most prominent characteristic of the tube lamp is maintaining the overall uniformity of building decorations and avoiding damage to the perfection and uniformity of ceiling art due to the placement of lamps. A tube lamp usually has a screw base, and can be directly equipped with an incandescent light bulb or energy-saving bulb. At present, the majority of light fittings are installed through lock screws and are compatible with a few mounting box sizes; besides, alignment is needed during installation of the lighting fittings, so operation is inconvenient.

DETAILED CONTENTS OF THE PRESENT INVENTION

The technical problem to be solved in the present invention is to provide a tube lamp with higher compatibility.

In order to solve the above technical problem, the present invention employs the following technical solution: a tube lamp is disclosed, including a mounting box and a lamp body matched with the mounting box, wherein the mounting box includes a top plate and side wall boards around the top plate. The tube lamp also includes a fixed board.

The fixed board includes a fixed board body. At least two sets of fasteners are disposed at the two ends of the fixed board body; the fasteners are interspaced; and the fixed board is detachably connected to the mounting box through the fasteners.

The lamp body is connected to the mounting box through the fixed board.

Further, the fixed board body also includes a middle snap joint base; the lamp body is provided with a snap joint; the snap joint is matched with the snap joint base; the top plate and the side wall boards form an accommodating cavity; the snap joint is in snap-fit with the snap joint base, and the snap joint is received in the accommodating cavity.

Further, the snap joint base is a round through-hole formed on the body; the snap joint includes a metal spring plate; and the two ends of the metal spring plate are bent toward each other.

Further, the metal spring plate includes a bottom plate and a first side plate and a second plate which are disposed at two ends of the bottom plate and are bent toward each other; the upper end of the first side plate extends outward to form a stop portion, while the second side plate is connected to the outer end of the stop portion.

Further, the fastener includes screw holes formed on the fixed board body; the mounting box is provided with connecting columns along the inner wall faces of the side wall boards; the connecting columns are provided with connecting holes; the fixed board is detachably connected to the mounting box through the screw holes and screws in the connecting holes.

Further, three sets of screw holes are provided.

The present invention has the following beneficial effects: at least two sets of fasteners are disposed at the two ends of the fixed board body; the fasteners are used for connection with the mounting box; the two sets of fasteners are interspaced, capable of being applied to mounting boxes of different sizes, and capable of being compatible with many mounting boxes of different sizes, and have higher compatibility.

DESCRIPTION OF SEVERAL VIEWS OF THE ATTACHED DRAWINGS

DESCRIPTION OF MARKS

1. mounting box; 11. top plate; 12. side wall board; 2. fixed board; 21. fixed board body; 22. snap joint base; 23. fastener; 3. lamp body; 4. metal spring plate; 41. bottom plate; 42. first side plate; 43. stop portion; 44. second side plate.

DETAILED DESCRIPTION OF THE PRESENT INVENTION

The technical contents, fulfilled objective and effects of the present invention are described in detail with reference to the embodiments and attached drawings.

The most important concept of the present invention lies in that at least two sets of fasteners are disposed at the two ends of a fixed board body 21 of a tube lamp; the fasteners 23 are used for connection with the mounting box 1; the two sets of fasteners are interspaced, capable of being applied to mounting boxes 1 of different sizes, so the tube lamp has higher compatibility.

Figure 1:
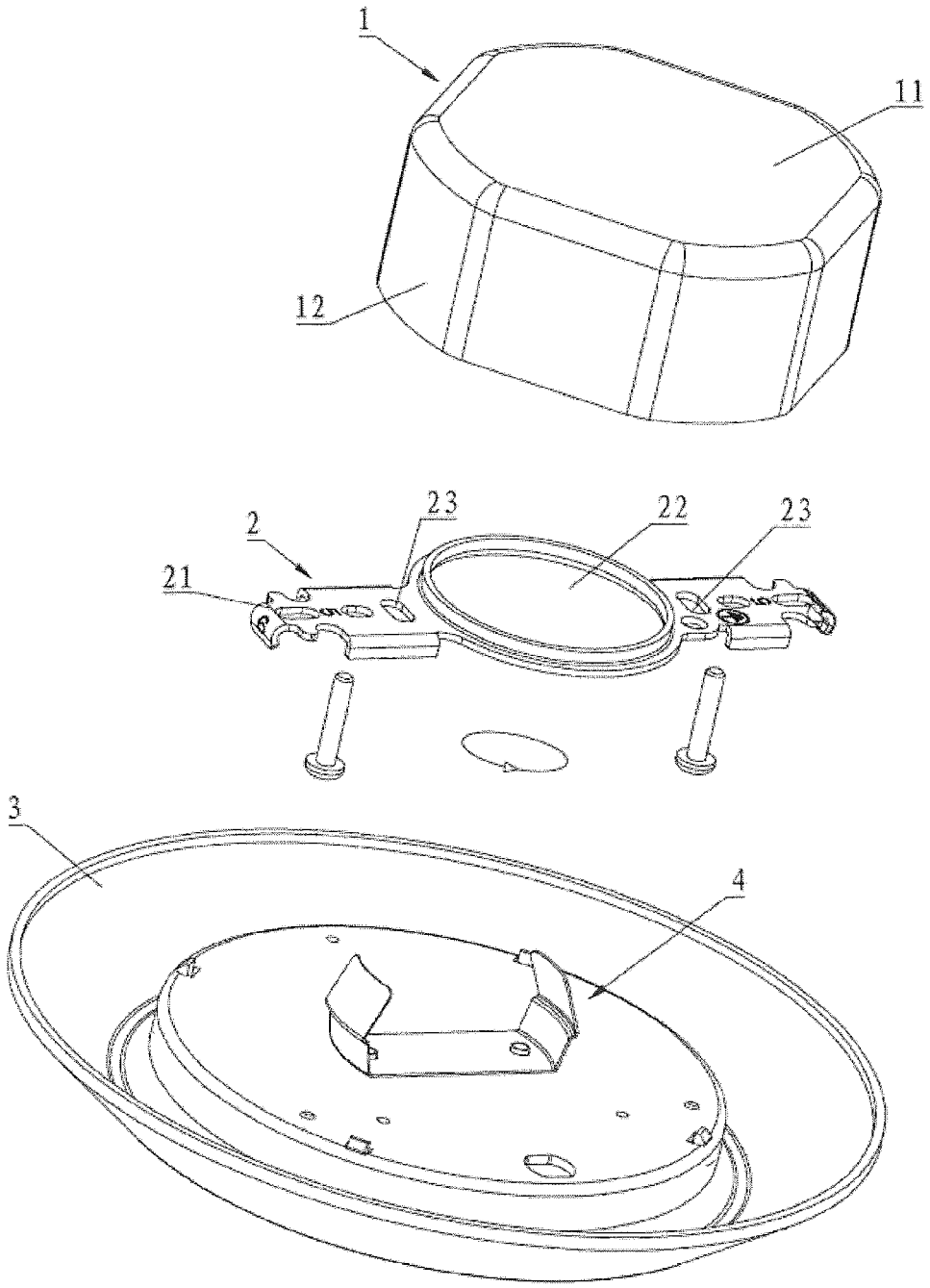
FIG. 1 is a structural exploded view of a tube lamp according to an embodiment of the present invention.
Figure 2:
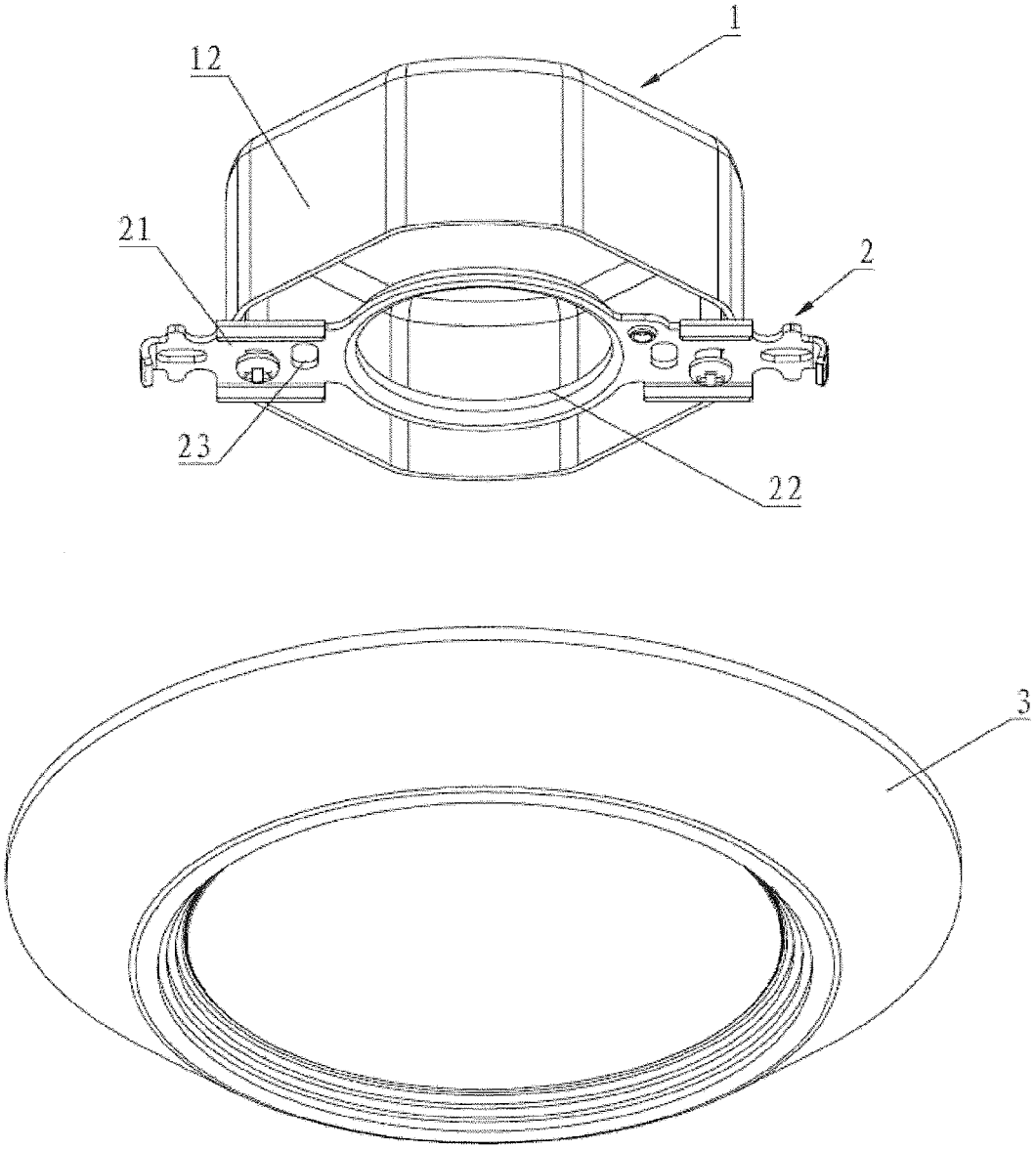
FIG. 2 is a structural view of the tube lamp being installed according to an embodiment of the present invention.
Figure 3:
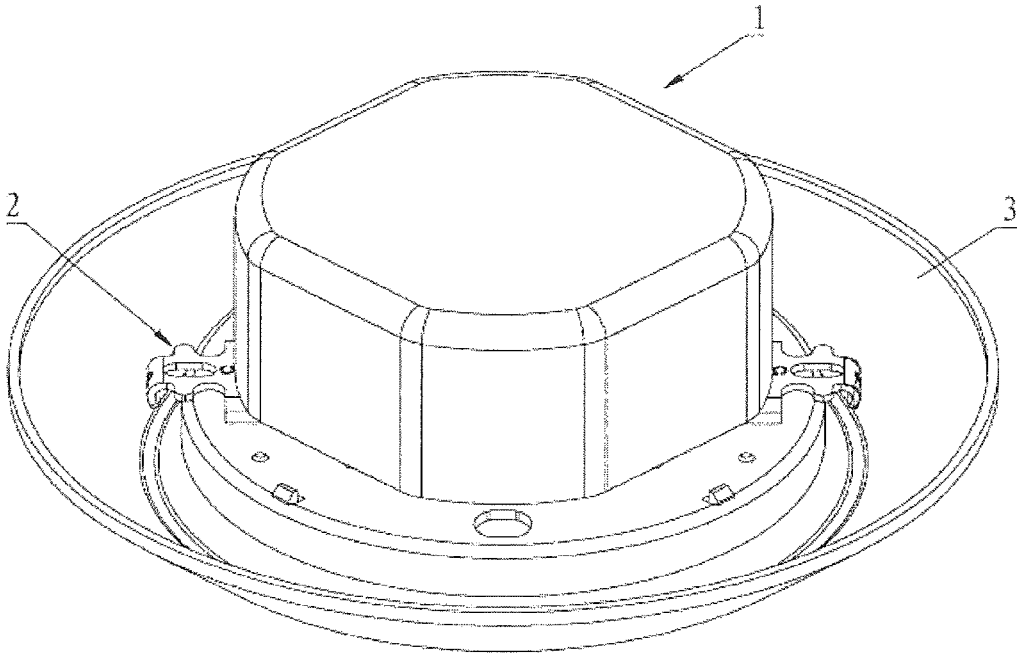
FIG. 3 is a structural view of the tube lamp after being installed according to an embodiment of the present invention.

Refer to FIG. 1-FIG. 3. A tube lamp according to the present invention includes a mounting box 1 and a lamp body 3 matched with the mounting box 1. The mounting box 1 includes a top plate 11 and side wall boards 12 around the top plate 11. The tube lamp also includes a fixed board 2.

The fixed board 2 includes a fixed board body 21; at least two sets of fasteners 23 are disposed at the two ends of the fixed board body 21; and the fasteners are interspaced; the fixed board 2 is detachably connected to the mounting box 1 through the fasteners 23.

The lamp body 3 is connected to the mounting box 1 through the fixed board 2.

From the above description it is known that the present invention has the following beneficial effects: at least two sets of fasteners are disposed at the two ends of the fixed board body 21; the fasteners 23 are used for connection with the mounting box 1; the two sets of fasteners are interspaced, capable of being applied to mounting boxes 1 of different sizes, and capable of being compatible with many mounting boxes 1 of different sizes, so the tube lamp has higher compatibility.

Further, the fixed board body 21 also includes a middle snap joint base 22; the lamp body 3 is provided with a snap joint; the snap joint is matched with the snap joint base 22; the top plate 11 and the side wall boards 12 form an accommodating cavity; the snap joint is in snap-fit with the snap joint base 22, and the snap joint is received in the accommodating cavity.

From the above description it is known that the snap-joint connection mode, in comparison with the prior art, can effectively save mounting time, reduce mounting cost, and bring convenience to repairs in the future.

Further, the snap joint base 22 is a round through-hole formed on the body; the metal spring plate 4 includes the snap joints; and the two ends of the metal spring plate 4 are bent toward each other.

From the above description it is known that the structure formed by the round through-hole and the metal spring plate 4 can realize quick installation without alignment in the horizontal direction.

Figure 4:
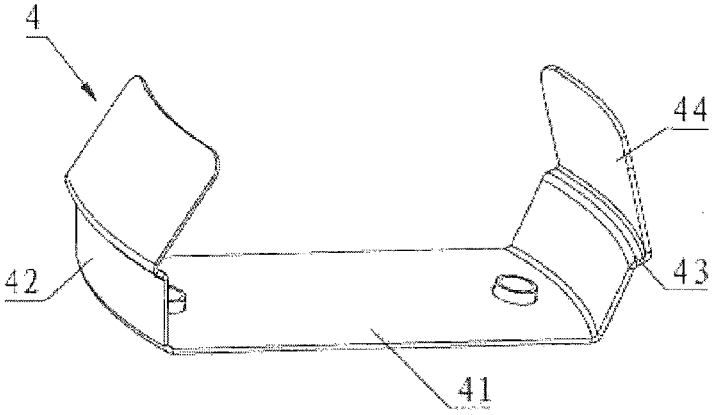
FIG. 4 is a structural view of a metal spring plate according to an embodiment of the present invention.

Further, as shown in FIG. 4, the metal spring plate 4 includes a bottom plate 41 and a first side plate 42 and a second plate 44 which are disposed at two ends of the bottom plate 41, The first and second side plates 42, 44 initially extend outward relative to each other, form respective stop portions 43 (snap joints) and then the upper parts of the first and second plates 42, 44 extend from the stops portions 43 toward each other.

Further, the fastener 23 includes screw holes formed on the fixed board body 21; the mounting box 1 is provided with connecting columns along the inner wall faces of the side wall boards 12; the connecting columns are provided with connecting holes; the fixed board 2 is detachably connected to the mounting box 1 through the screw holes and screws in the connecting holes.

From the above description it is known that, the screw hole is mated with the connecting hole so that the fixed board 2 and the mounting box 1 can be conveniently, quickly and firmly installed, and the screw hole is a simple mating structure, is low in cost and easy to manufacture.

Further, three sets of screw holes are provided.

Refer to FIG. 1-FIG. 4. The first embodiment of the present invention is as follows. A tube lamp according to the present invention includes a mounting box 1 and a lamp body 3 matched with the mounting box 1. The mounting box 1 includes a top plate 11 and side wall boards 12 around the top plate 11.

The tube lamp also includes a fixed board 2. The fixed board 2 comprises a fixed board body 21. The two ends of the fixed board body 21 are each provided with three sets of screw holes, and the three sets of the screw holes are interspaced from one another. The fixed board 2 is detachably connected to the mounting box 1 through screw holes. The mounting box 1 is provided with connecting columns along the inner wall faces of the side wall boards 12; the connecting columns are provided with connecting holes; the fixed board 2 is detachably connected to the mounting box 1 through the screw holes and screws in the connecting holes.

The fixed board body 21 also comprises a middle snap joint base 22; the lamp body 3 is provided with snap joints (elements 43); the snap joints are matched with the snap joint base 22; the top plate 11 and the side wall boards 12 form an accommodating cavity; the snap joints are in snap-fit with the snap joint base 22, and snap joints are received in the accommodating cavity. The snap joint base 22 is a round though-hole formed on the fixed board body 21. The metal spring plate 4 comprises the snap joints (stop portions 43); the two ends of the metal spring plate 4 are bent toward each other; the metal spring plate 4 comprises a bottom plate 41 and a first side plate 42 and a second side plate 44 which are disposed at the two ends of the bottom plate 41. The first and second side plates 42, 44 initially extend outward relative to each other, form respective stop portions 43 (the snap joints noted above) and then the upper parts of the first and second plates 42, 44 extend from the stops portions 43 toward each other.

In conclusion, the tube lamp provided by the present invention has high compatibility, can perform quick installation without alignment on the horizontal direction, greatly improving installation efficiency while realizing a simple structure and low cost.

The above are only some embodiments of the present invention and shall not be regarded as limit to the present invention. Any equivalent modifications made on the basis of the description and attached drawings of the present invention, or direct or indirect application to the related fields, shall fall within the protective scope of the present invention.

The invention claimed is:

1. A tube lamp, comprising:

a mounting box;

a lamp body matched with the mounting box, the mounting box comprising a top plate and side wall boards around the top plate;

a fixed board comprising a fixed board body; and at least two sets of fasteners disposed along a longitudinal direction of and at each end of the fixed board body;

wherein:

the fasteners are interspaced;

the fixed board is detachably connected to the mounting box through the fasteners;

the lamp body is connected to the mounting box through the fixed board;

the fixed board body further comprises a middle snap joint base;

the lamp body is provided with snap joints, the snap joints being matched with the snap joint base;

the top plate and the side wall boards form an accommodating cavity;

the snap joints are in snap-fit with the snap joint base in a vertical direction, and the snap joints are received in the accommodating cavity;

the snap joint base is a round through-hole formed on the body; and a metal spring plate comprises a bottom plate and a first side plate and a second side plate which are disposed at two ends of the bottom plate, lower ends of the first and second side plates respectively extend from the bottom plate and away from each other, upper ends of the first and second side plates extend toward each other, and the snap joints are respectively formed between the lower and upper ends of the first and second side plates.

2. The tube lamp according to claim 1, wherein:

the fastener comprises sets of screw holes formed on the fixed board body;

the mounting box is provided with connecting columns along inner wall faces of the side wall boards, the connecting columns being provided with connecting holes; and the fixed board is detachably connected to the mounting box through the screw holes and screws in the connecting holes.

3. The tube lamp according to claim 2, wherein, of the sets of screw holes are three in number.

* * * * *